US011015619B2

(12) United States Patent
Erhard et al.

(10) Patent No.: US 11,015,619 B2
(45) Date of Patent: May 25, 2021

(54) PRESSURE INTENSIFIER DEVICE, DIECASTING MACHINE CASTING UNIT AND OPERATING METHOD

(71) Applicant: Oskar Frech GmbH + Co. KG, Schorndorf (DE)

(72) Inventors: Norbert Erhard, Lorch (DE); Peter Maurer, Bamberg (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 846 days.

(21) Appl. No.: 15/549,464

(22) PCT Filed: Feb. 9, 2016

(86) PCT No.: PCT/EP2016/052690

§ 371 (c)(1),
(2) Date: Aug. 8, 2017

(87) PCT Pub. No.: WO2016/128381

PCT Pub. Date: Aug. 18, 2016

(65) Prior Publication Data

US 2018/0023597 A1 Jan. 25, 2018

(30) Foreign Application Priority Data

Feb. 9, 2015 (DE) ..... 10 2015 202 273.0

(51) Int. Cl.

| | |
|---|---|
| ***F15B 3/00*** | (2006.01) |
| ***B22D 17/20*** | (2006.01) |
| ***B22D 17/32*** | (2006.01) |

(52) U.S. Cl.

CPC ..... *F15B 3/00* (2013.01); *B22D 17/203* (2013.01); *B22D 17/2069* (2013.01); *B22D 17/32* (2013.01)

(58) Field of Classification Search

CPC .. B22D 17/203; B22D 17/2069; B22D 17/32; F15B 3/00

See application file for complete search history.

(56) References Cited

U.S. PATENT DOCUMENTS

| | | |
|---|---|---|
| 3,601,180 A | 8/1971 | Nef et al. |
| 3,693,702 A | 9/1972 | Piekenbrink et al. |

(Continued)

FOREIGN PATENT DOCUMENTS

| | | |
|---|---|---|
| CN | 1472442 A | 2/2004 |
| CN | 102317007 A | 1/2012 |

(Continued)

OTHER PUBLICATIONS

Chinese-language Office Action issued in counterpart Chinese Application No. 201680020785.6 dated Oct. 23, 2018 (nine pages).

(Continued)

*Primary Examiner* — Kevin P Kerns
*Assistant Examiner* — Steven S Ha
(74) *Attorney, Agent, or Firm* — Crowell & Moring LLP

(57) ABSTRACT

A pressure intensifier device for increasing pressure in a pressurized fluid chamber of a piston/cylinder unit and a casting unit provided therewith for a diecasting machine, and also an associated operating method are provided. The pressure intensifier device has a pressure intensifier cylinder and a pressure intensifier piston, which is guided in an axially movable manner in the cylinder, wherein the pressure intensifier cylinder has an outlet region, an inlet region upstream of the outlet region and a piston guiding chamber, and the pressure intensifier piston has a piston part, which is guided in the piston guiding chamber, and a piston rod, which extends from the piston part to the inlet region, in a maximally retracted release position releases a fluid connection between the inlet region and the outlet region and, in a maximally advanced blocking position, blocks this connection with a free end portion, with which it extends (Continued)

into the outlet region. Over a portion that can be passed through by the free end portion of the piston rod during movement from the release position into the blocking position, the outlet region has a free passage cross section for the free piston rod end portion that is at least equal in size to a rod cross section of the free piston rod end portion. Advantageously, a pressure intensifier inlet valve can be controlled independently of a pressure in the pressurized fluid chamber of the piston/cylinder unit.

20 Claims, 4 Drawing Sheets

(56) References Cited

U.S. PATENT DOCUMENTS

| | | | |
|---|---|---|---|
| 6,895,749 | B2 | 5/2005 | Tohru |
| 8,887,502 | B2 | 11/2014 | Hauser |
| 2008/0164002 | A1 | 7/2008 | Yurko et al. |
| 2011/0247777 | A1 | 10/2011 | Hauser |

FOREIGN PATENT DOCUMENTS

| | | | | |
|---|---|---|---|---|
| CN | 204194765 | U | 3/2015 | |
| DE | 19 49 360 | C3 | 4/1970 | |
| DE | 20 17 951 | B2 | 4/1971 | |
| DE | 31 45 401 | A1 | 5/1983 | |
| DE | 3145401 | A1 * | 5/1983 | ..... F15B 11/0325 |
| DE | 201 00 122 | U1 | 6/2001 | |
| DE | 10 2004 010 438 | B3 | 6/2005 | |
| EP | 2 365 888 | B1 | 3/2013 | |
| JP | 61-193763 | A | 8/1986 | |
| JP | 2004-66253 | A | 3/2004 | |
| JP | 2004-160484 | A | 6/2004 | |
| JP | 2005-21976 | A | 1/2005 | |
| JP | 2005-83512 | A | 3/2005 | |
| JP | 2012-512032 | A | 5/2012 | |
| WO | WO 2010/070053 | A1 | 6/2010 | |

OTHER PUBLICATIONS

International Search Report (PCT/ISA/210) issued in PCT Application No. PCT/EP2016/052690 dated May 20, 2016 with English translation (Four (4) pages).

German-language Written Opinion (PCT/ISA/237) issued in PCT Application No. PCT/EP2016/052690 dated May 20, 2016 (Eight (8) pages).

Japanese-language Office Action issued in Japanese Application No. 2017-541806 dated Jan. 7, 2020 with English translation (nine (9) pages).

* cited by examiner 1
2
3
4
4a
5a
5b
6
7
8
9
10
11
11a
11b
12
13
14
14a
14b
15
16
17
18
19
20
21
22
23
24
32
32a
32b
32c
32d
33
33a
34
34a 1
2
3
4
4a
5a
5b
6
7
10
11
11a
11b
12
13
14
14a
15
16
17
25
26

1
2
3
4
6
7
8
9
10
11
11a
11b
12
13
15
18
19
20
21
22
23
B1
S1
S2

Fig. 10
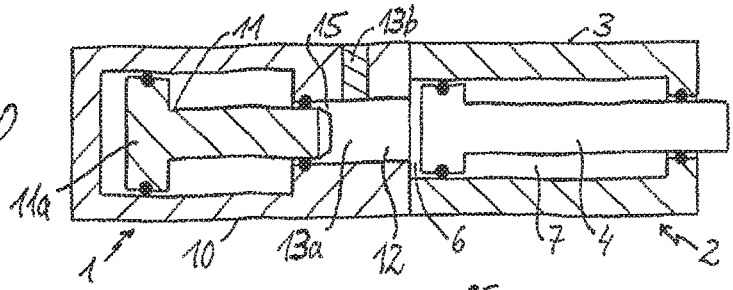
Fig. 11
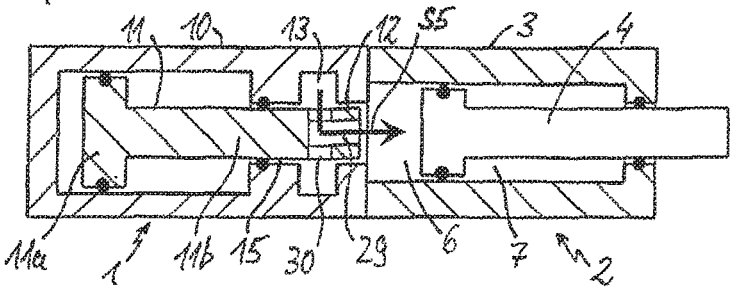
Fig. 12
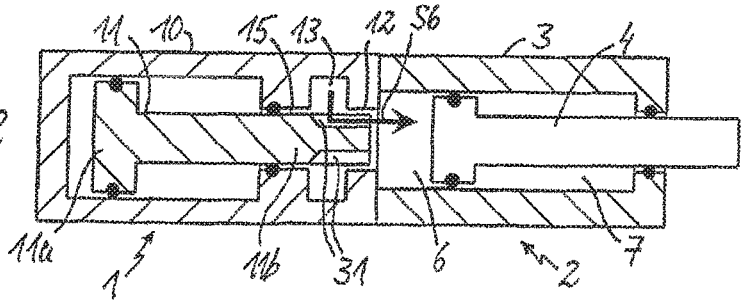
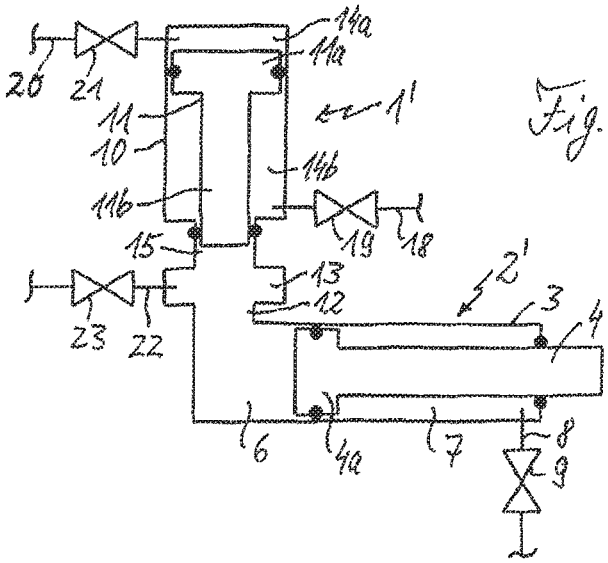
Fig. 13

PRESSURE INTENSIFIER DEVICE, DIECASTING MACHINE CASTING UNIT AND OPERATING METHOD

BACKGROUND AND SUMMARY OF THE INVENTION

The invention relates to a pressure intensifier device for increasing pressure in a pressurized fluid chamber of a piston/cylinder unit, said pressure intensifier comprising a pressure intensifier cylinder and a pressure intensifier piston, which is guided in an axially movable manner in the cylinder, wherein the pressure intensifier cylinder comprises an outlet region, an inlet region upstream of the outlet region, and a piston guiding chamber having at least one of a pressure intensifier piston chamber, into which a pressure intensifier inlet line opens, and a pressure intensifier back-pressure chamber, into which a pressure intensifier back-pressure line opens. The pressure intensifier piston comprises a piston part, which is guided in the piston guiding chamber, and a piston rod, which extends from the piston part to the inlet region, in a retracted release position releases a fluid connection between the inlet region and the outlet region and, in an advanced blocking position, blocks this connection with a free end portion, with which it extends into the outlet region. Over a portion that can be passed through by the free end portion of the piston rod during movement from the release position into the blocking position, the outlet region comprises a free passage cross section for the free piston rod end portion that is at least equal in size to a rod cross section of the free piston rod end portion. The invention further relates to a casting unit provided therewith for a diecasting machine and also to an associated operating method.

A pressure intensifier device of this kind is used, for example, to increase the pressure in a pressurized fluid chamber of a casting piston/casting cylinder unit, with which a casting unit of a diecasting machine is provided. However, it can furthermore be used for any other purposes wherever a pressure increase is required in a pressurized fluid chamber of a piston/cylinder unit to ensure that a working piston or operative piston of the piston/cylinder unit performs a desired work function or useful function. In the design under consideration in the present case, the pressure intensifier device itself is manufactured as a piston/cylinder unit with a pressure intensifier cylinder and a pressure intensifier piston guided in an axially movable manner in the cylinder. In diecasting machines, the pressure intensifier device is used primarily to provide the increased follow-up pressure for a casting piston toward the end of a casting process. Here, the pressure intensifier is also often referred to as a multiplier.

It is conventional for a check valve to be installed in an inlet leading to the pressurized fluid chamber of a casting piston/casting cylinder unit to be controlled in order to avoid a return flow of pressure medium out of the higher-pressure pressurized fluid chamber back to a pressurized fluid reservoir, for example. In the case of a multiplier device disclosed in patent publication DE 19 49 360 C3, the check valve is integrated into the multiplier piston.

There are various known pressure intensifier devices in which the pressure intensifier cylinder has an outlet region, an inlet region upstream of the outlet region and a piston guiding chamber. The pressure intensifier piston comprises a piston part, which is guided in the piston guiding chamber, and a piston rod, which extends from the piston part in the direction of the inlet region, in a maximally retracted release position releases a fluid connection between the inlet region and the outlet region and, in a maximally advanced blocking position, blocks this connection with a free end portion, with which it extends into the outlet region.

Patent publication EP 2 365 888 B1 discloses a pressure intensifier device of this kind with an integrated check valve. Arranged in the outlet region in this known pressure intensifier device is a valve sleeve, which is capable of moving axially with a limited stroke and, on its end facing the multiplier piston, has a conical valve cone seat, which forms a check valve with a free end of the multiplier piston rod, which is configured so as to have a correspondingly conical valve cone shape. To achieve this, the valve-seat end of the valve sleeve axially adjoins the inlet region, which is formed as a cylindrical portion with a larger diameter than a piston rod guiding portion and an inlet-side portion of the outlet region or of the valve sleeve. The piston rod is guided between the piston guiding chamber and the inlet region in the piston rod guiding portion of the pressure intensifier cylinder. A piston chamber of the multiplier is connected to the inlet region by one or more through holes in the end portion of the multiplier piston rod. As it moves past, the multiplier piston strikes against the facing end of the valve sleeve, thereby closing the check valve formed thereby. The multiplier piston then takes the valve sleeve along during the continued forward motion.

Check valves are not without problems, particularly when used in casting piston/casting cylinder units of diecasting machines. They entail expenditure on production, are prone to failure and are susceptible to wear. For example, in the case of spring-actuated valves, secondary damage which is in some cases considerable can occur owing to spring breakage.

Patent publication DE 10 2004 010 438 B3 discloses a hydropneumatic pressure intensifier intended for high-pressure applications and having at least one hydraulic cylinder region, which contains a high-pressure region and comprises a working piston, and having at least one pneumatic cylinder region, which comprises a pressure intensifier piston. In the case of this pressure intensifier, the forward motion of the intensifier piston is started when the forward pressure exerted on the working piston reaches a certain backpressure value, at which, for example, a valve connected upstream of the pressure intensifier switches when a machining tool carried by a working piston rod comes to rest on a tool to be machined.

Similar differential pressure control of a pressure intensifier piston is provided for a pressure-intensified force cylinder unit in Laid-Open publication DE 31 45 401 A1. In this differential pressure control system, the fluid pressure acting in the feed direction on a working piston is fed back to a pressure intensifier chamber via a suction nozzle or a controlled slide valve, with the result that the pressure intensifier piston is acted upon by a differential pressure, which moves it forward as soon as the differential pressure exceeds an associated minimum value.

Pre-patent publication DE 20 17 951 discloses a diecasting machine having a multiplier in which the feed motion of the multiplier piston is started in similar fashion when, toward the end of a pressure or casting piston stroke, at the end of the die filling phase of a respective casting process, the pressure in the working chamber of the pressure/casting cylinder rises owing to the fact that the die has now been filled. A hydraulic pilot control element, which can be set to a particular pressure, then actuates a sequence valve in order to introduce pressurized fluid into a multiplier piston chamber.

An object of the invention is to provide a pressure intensifier device of the type stated at the outset which can be manufactured with a relatively low outlay and has high functional reliability and low susceptibility to wear. Further objects of the invention are to provide a casting unit provided with a pressure intensifier device of this kind for a diecasting machine and to provide an operating method therefor.

The invention achieves these and other objects by providing a specific pressure intensifier device having inventive features, a specific casting unit having inventive features, and a specific operating method having inventive features. Such features are mentioned in the independent claims. Advantageous developments of the invention are indicated in the dependent claims.

In the pressure intensifier device according to the invention, the outlet region of the pressure intensifier cylinder has, in a portion that is passed through by the free end portion of the piston rod during movement from the release position thereof into the blocking position thereof, a passage cross section that is at least equal in size to a rod cross section of the free piston rod end portion. The consequence of this is that the piston rod of the pressure intensifier piston can extend unhindered into the outlet region when it is moved forward to provide the desired pressure increase. When required, the piston rod of the multiplier piston can move forward through the outlet region of the multiplier piston and beyond the latter into the pressurized fluid chamber of the coupled piston/cylinder unit in order to provide the desired pressure increase by appropriate volume displacement. There is no need for a check valve in this pressure intensifier device, and the elimination of corresponding moving valve components reduces the outlay on production. Failures and malfunctions, e.g. spring breakages of spring-actuated mechanical components, which can occur in conventional pressure intensifier devices owing to a check valve of this kind, are likewise eliminated.

Significant backflow of pressurized fluid from the pressurized fluid chamber of a coupled piston/cylinder unit or from the outlet region of the pressure intensifier cylinder into the inlet region is prevented by the fact that, in the blocking position, the piston rod of the multiplier piston blocks the otherwise opened fluid connection between the inlet region and the outlet region. Depending on requirements, blocking of this fluid connection can be implemented as a complete shutoff or merely as a predominant shutoff of the maximum passage cross section of this fluid connection. In the latter case, the flow cross section of a residual fluid connection remaining between the inlet region and the outlet region is significantly smaller than the maximum flow cross section when the piston rod is retracted into the release position, e.g. less than 10% and preferably less than 1% of this maximum flow cross section and, in particularly advantageous embodiments, in a range of from about 0.01% to about 0.1% of the maximum flow cross section. A residual fluid connection of this kind can be formed, for example, by one or more corresponding gap regions between the outer circumference of the piston rod and an inner circumference of an opposite cylindrical portion of the outlet region. In appropriate applications, it does not lead to any significant impairment of the pressure increasing function of the pressure intensifier device, e.g. when used in a casting unit of a diecasting machine, taking into account the rapid time sequence of a typical pressure increasing phase toward the end of a casting process.

According to one aspect of the invention, a pressure intensifier inlet valve, which is controlled independently of a pressure in the pressurized fluid chamber of the piston/cylinder unit, is arranged in the pressure intensifier inlet line, which opens into a pressure intensifier piston chamber of the piston guiding chamber of the pressure intensifier cylinder, and the outlet region is embodied without a check valve. The latter statement means that no check valve is coupled to a volume defined by this region, including the adjoining pressurized fluid chamber of the piston/cylinder unit. As a result, the feed motion of the pressure intensifier piston can advantageously be controlled independently of the pressure conditions in the piston/cylinder unit assigned to the pressure intensifier device. In particular, the feed motion of the pressure intensifier piston can be controlled in a respectively desired manner without being influenced by any pressure fluctuations and delay times of the pressurized fluid used in the piston/cylinder unit and of the pressure exerted thereby. By means of this measure, it is furthermore possible, in contrast to the conventional differential pressure control systems explained above, to start the forward motion of the pressure intensifier piston at a relatively early stage and, in particular, even before a differential pressure that is building up has exceeded a predetermined threshold value.

Apart from the advantages already mentioned above, the elimination of said check valve furthermore entails the elimination of time-delayed behavior, required by said valve, in respect of the pressure rise time for the pressure increase provided by the pressure intensifier device, and this can improve the casting process when used in diecasting machines.

According to another aspect of the invention, the outlet region of the pressure intensifier cylinder is designed as a portion which is narrowed radially relative to the inlet region. In this embodiment, the fluid connection between the inlet region and the outlet region can be blocked by the pressure intensifier piston by virtue of the fact that it moves forward from the inlet region with the larger cross section into the outlet region with the narrowed, smaller cross section. In this case, it is expedient if the cross section of the free piston rod end portion extending into the outlet region is approximately equal in size or only slightly smaller, e.g. less than 10% and preferably less than 1% smaller, than that portion of the outlet region which accommodates it, in particular, for example, less than about 0.01% to about 0.1% thereof.

It is expedient if a diameter of the relevant portion of the outlet region is greater than a diameter of the free piston rod end portion, with the result that, as the piston rod end portion moves forward into the outlet region, an intermediate annular gap is formed. Depending on the application, this annular gap can remain open or can be sealed off by means of a suitable ring seal. As an alternative or in addition to this measure, the circumferential rim of the cylindrical portion of the outlet region which accommodates the free piston rod end portion has an insertion cone on the inlet side. This can facilitate the insertion of the piston rod moved forward from the inlet region into the outlet region. If required, the piston rod can have a correspondingly conical shape on the free end thereof.

As a development of the invention, the pressure intensifier cylinder is manufactured as a one-piece component. This contributes to the minimization of the outlay on production. In this case, the integral, i.e. one-piece, pressure intensifier cylinder component can be coupled directly to the pressurized fluid chamber of the piston/cylinder unit in which the pressure increase is required, as well as to a pressurized fluid working chamber of a casting piston/casting cylinder unit of a diecasting machine.

As a development of the invention, the pressure intensifier cylinder has a piston rod guiding portion between the piston guiding chamber and the inlet region. This guiding portion can assist with the guidance of the multiplier piston during the axial movement thereof. It can be advantageous here in terms of manufacturing technology to form the piston rod guiding portion with the same diameter as that of the portion of the outlet region which accommodates the piston rod which is moved forward.

In a development of the invention, the outlet region and the inlet region of the pressure intensifier cylinder have portions with a same cross section, wherein the inlet region furthermore contains a radial inlet bore, which opens radially from the outside into said inlet region portion of the pressure intensifier cylinder. This allows particularly simple manufacture of the pressure intensifier cylinder and very reliable guidance of the multiplier piston during the pressure-increasing forward motion thereof. By means of the forward motion of the multiplier piston, it is possible to shut off the radial inlet bore and in this way to provide the function for blocking the fluid connection between the inlet region and the outlet region.

In a development of the invention, the inlet region contains at least one radial bore and an axial bore in the free piston rod end portion, said axial bore being connected to said radial bore and opening at the end face. In this embodiment, the pressurized fluid is consequently fed into the pressurized fluid chamber of the piston/cylinder unit to be controlled through the free end portion of the multiplier piston rod. In this implementation, the fluid connection between the inlet region and the outlet region can be blocked by shutting off the radial piston rod bore through the outlet region. If required, the piston rod of the multiplier piston can extend into the outlet region even in the maximally retracted release position, which can further improve the guidance of the multiplier piston in the multiplier cylinder.

In a development of the invention, the inlet region contains at least one axial longitudinal groove channel on a circumferential side of the free end portion of the multiplier piston rod. In this case, the pressurized fluid to be fed to the piston/cylinder unit to be controlled flows along the axial longitudinal groove channel or channels of the piston rod into the pressurized fluid working chamber of the piston/cylinder unit to be controlled. In this variant embodiment, the blocking of the fluid connection between the inlet region and the outlet region can be brought about by shutting off the axial longitudinal groove channel or channels from the remainder of the inlet-side inlet region through the outlet region. In this embodiment too, the piston rod of the multiplier piston can still extend into the outlet region in the maximally retracted release position.

In a development of the invention, a ring seal is arranged on an inner rim of the outlet region. This allows sealing and/or additional guidance for the multiplier piston rod.

In a development of the invention, the pressure intensifier device contains an operative piston position sensor for detecting the position of a piston of the piston/cylinder unit and/or a multiplier piston position sensor for detecting the position of the pressure intensifier piston, and a controller, which controls the pressure intensifier inlet valve in accordance with an operative piston position signal of the operative piston position sensor and/or in accordance with a multiplier piston position signal of the multiplier piston position sensor, and/or controls the pressure intensifier back-pressure valve in accordance with an operative piston position signal of the operative piston position sensor and/or in accordance with a multiplier piston position signal of the multiplier piston position sensor. It is thereby possible, in particular, to control the feed motion of the multiplier piston in accordance with the current position of the piston of the piston/cylinder unit and/or with the current position of the multiplier piston, which can, in turn, be of particular advantage, especially when used in a casting unit for a diecasting machine. Thus, for example, the forward motion of the multiplier piston can be started even in a relatively early stage of the total working stroke of the casting piston of a casting piston/casting cylinder unit, this allowing extremely short pressure rise times with minimization or elimination of a delay in the pressure rise as compared with the conventional arrangements mentioned at the outset with a check valve and/or differential pressure control, and thereby also allowing an improvement in casting quality.

Moreover, this measure according to the invention opens up the possibility, if desired, of using open-loop or closed-loop control to freely determine the forward motion of the multiplier piston as regards the progress thereof with respect to time along the complete stroke thereof from the maximally retracted to the maximally advanced position or only along a subsection of this complete stroke, completely independently of the pressure conditions in the various pressure volumes, this free determination being in the form, for example, of a predetermined profile of the progress with respect to time of the path of movement or speed of movement of the multiplier piston or in accordance with a predetermined profile of the progress with respect to time of the pressure in the pressurized fluid chamber of the piston/cylinder unit.

A casting unit according to the invention for a diecasting machine, which unit is provided with the pressure intensifier device according to the invention, allows increased economy in the diecasting machine and increased quality of the products cast with said machine. The invention also comprises a diecasting machine which has a casting unit of this kind.

The diecasting machine casting unit according to the invention can be operated, in particular, by the method according to the invention, in which case the feed motion of the pressure intensifier piston of the pressure intensifier device is then characteristically started before the end of the die filling phase. In comparison with conventional operating methods, in which the pressure intensifier piston is started only after the end of the die filling phase owing to the associated pressure rise in the casting cylinder, this allows a shortening of the time required for the casting process and furthermore creates the prerequisite for a casting process sequence which is also optimized in other respects.

In a development of the invention, provision is made, in terms of the method, to start the feed motion of the pressure intensifier piston right at the beginning of or during the pre-filling phase and hence before the beginning of the die filling phase. This makes a further contribution to achieving pressure rise times which are as short as possible and thus to improving the casting quality.

In a development of the invention, the feed motion of the pressure intensifier piston is, according to the method, controlled by open-loop or closed-loop control in accordance with the operative piston position signal of the operative piston position sensor and/or in accordance with the multiplier piston position signal of the multiplier piston position sensor if the pressure intensifier device has an operative piston position sensor or multiplier piston position sensor of this kind. It is thereby advantageously possible to couple the feed motion of the pressure intensifier piston to the feed motion of the casting piston without being dependent on the pressure conditions of a working fluid and/or of the molten material to be cast in the casting cylinder.

In a development of the method according to the invention, the feed motion of the pressure intensifier piston is subject to open-loop or closed-loop control as regards the progress thereof with respect to time along the complete stroke thereof from the maximally retracted to the maximally advanced position or only along a subsection of said complete stroke in accordance with a predetermined setpoint profile of the progress with respect to time of the path of movement or speed of movement of the multiplier piston, independently of the pressure conditions in the various participating pressure chambers, or in accordance with a predetermined setpoint profile of the progress with respect to time of the pressure in the pressurized fluid chamber of the piston/cylinder unit.

BRIEF DESCRIPTION OF THE DRAWINGS

Advantageous illustrative embodiments of the invention are shown in the drawings and are described below. In the drawings:

FIG. 10 shows the view of FIG. 2 relating to a variant with inlet and outlet regions with the same cross section, FIG. 11 shows the view of FIG. 2 relating to a variant with an axial inlet bore in the free end portion of the multiplier piston rod, FIG. 12 shows the view of FIG. 2 relating to a variant with axial longitudinal inlet groove channels in the free end portion of the multiplier piston rod, and FIG. 13 shows the view of FIG. 1 relating to a variant with a multiplier device arranged at an angle relative to the control piston/cylinder unit.

DETAILED DESCRIPTION OF THE DRAWINGS

Figure 1:
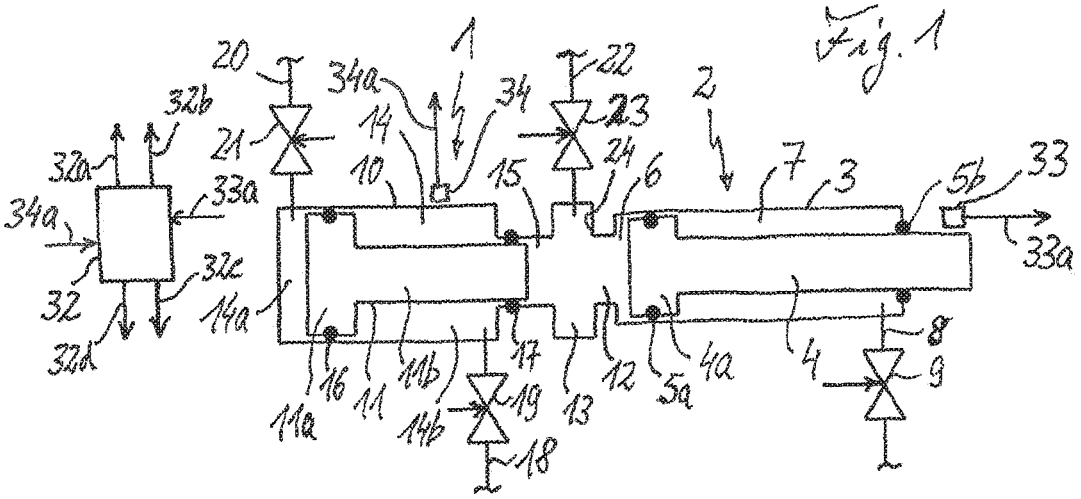
FIG. 1 shows a schematic side view of a multiplier device with a coupled casting piston/casting cylinder unit of a casting unit of a diecasting machine in an initial position.
Figure 2:
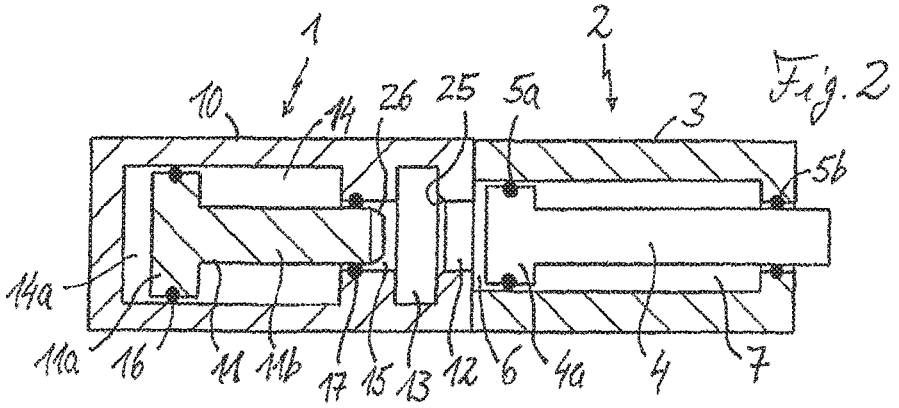
FIG. 2 shows a side view of an illustrative structural implementation of the arrangement in FIG. 1.
Figure 3:
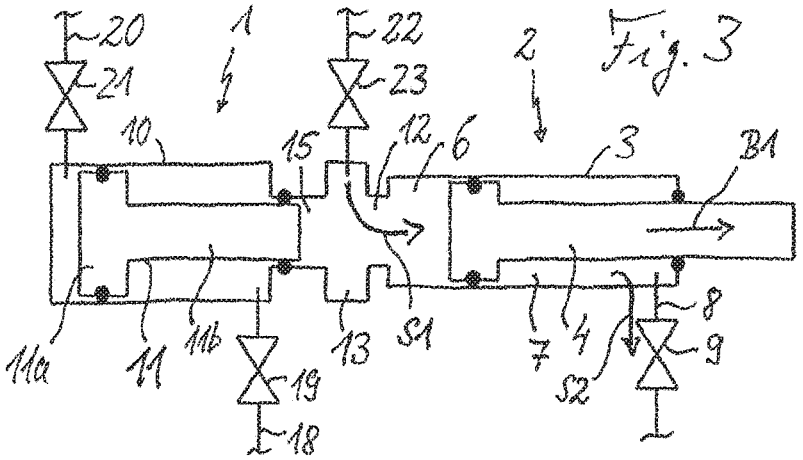
FIG. 3 shows the view of FIG. 1 in a first casting phase of a casting process of the diecasting machine.

The arrangement shown schematically in FIG. 1 comprises a pressure intensifier device 1, also referred to as a multiplier device or a multiplier for short, which is coupled to a piston/cylinder unit, here in the form of a casting piston/casting cylinder unit 2 of a diecasting machine. FIG. 2 shows a possible advantageous structural embodiment of this arrangement. Unless shown here, a casting unit, which comprises the casting piston/casting cylinder unit 2, and the diecasting machine provided therewith are of conventional construction.

In a conventional manner, the casting piston/casting cylinder unit 2 controlled by the multiplier contains a casting cylinder 3 and, as a working or operative piston, a casting piston 4, which is guided by means of a head part 4*a* in the casting cylinder 3. The head part 4*a* is supported fluidtightly, by means of a sealing and guiding system 5*a* that moves with it, against an inner wall of the casting cylinder 3 and divides the latter into a casting piston head chamber 6, which acts as a pressurized fluid chamber of the piston/cylinder unit 2, and an annular casting-piston chamber 7. By means of a piston rod part at the end opposite the head part 4*a*, the casting piston 4 extends out of the casting cylinder 3, with sealing by a sealing and guiding system 5*b* arranged on an associated through bore in the end of the casting cylinder 3. An outlet line 8 with an associated outlet valve 9 leads out of the annular casting-piston chamber 7. The casting piston head chamber 6 is embodied without a check valve, i.e. no check valve is coupled to this volume.

The multiplier 1 is likewise embodied as a piston/cylinder unit and comprises a pressure intensifier cylinder 10 and a pressure intensifier piston 11 guided in an axially movable manner in said cylinder. The multiplier cylinder 10 comprises an outlet region 12, an inlet region 13 upstream of the outlet region 12, and a piston guiding chamber 14. In addition, it has a piston rod guiding portion 15 between the piston guiding chamber 14 and the inlet region 13. At one end, the multiplier piston 11 has a piston part 11*a*, which is guided in the piston guiding chamber 14, and a piston rod 11*b*, which extends therefrom out of the piston guiding chamber 14 in the direction of the inlet region 13. By means of its piston part 11*a*, the multiplier piston 11 is guided in the piston guiding chamber 14 by way of a sealing and guiding system 16 that moves with it, while the piston rod 11*b* thereof is guided in the piston rod guiding portion 15 by insertion of a sealing and guiding system 17 into the piston rod guiding portion 15. Like the casting piston head chamber 6, the outlet region 12 is embodied without a check valve. In the example shown, the inlet region 13 is also preferably embodied without a check valve.

In the maximally retracted initial position shown in FIGS. 1 and 2, the piston rod 11*b* of the multiplier piston 11 extends into the piston rod guiding portion 15 and ends there ahead of the inlet region 13. In alternative embodiments, it is also possible for it to end in the inlet region 13. By means of its piston part 11*a* and the associated sealing and guiding system 16, the multiplier piston 11 divides the piston guiding chamber 14 of the multiplier cylinder 10 into a multiplier piston chamber 14*a* and a multiplier backpressure chamber 14*b*, which here forms an annular multiplier chamber 14*b*. Leading out of the annular multiplier chamber 14*b* is a backpressure line 18, also referred to as an outlet line, with an associated multiplier backpressure valve 19, also referred to as a multiplier outlet valve. A multiplier inlet line 20 with an associated multiplier inlet valve 21 opens into the multiplier piston chamber 14*a*. A casting piston inlet line 22 with an associated casting piston inlet valve 23 opens into the inlet region 13. It should be noted that, in the present case, the terms "inlet" and "outlet" have been chosen only to make a distinction and do not mean that a pressurized fluid could only be fed in or discharged via the relevant components. On the contrary, depending on the application, pressurized fluid can also be fed in via the outlet line and/or discharged via the inlet line, i.e. in order to provide a backpressure in the backpressure chamber 14*b* for a return movement of the multiplier piston 11. To achieve this, the backpressure does not have to be an excess pressure, it being sufficient for an appropriate differential pressure to prevail between the backpressure chamber 14*b* and the multiplier piston chamber.

In the illustrative embodiment in FIG. 1, the outlet region 12 is designed as a portion of the multiplier cylinder 10 which is narrowed radially relative to the inlet region 13. This is achieved by virtue of the fact that both regions are formed by associated axial, cylindrical portions of the multiplier cylinder 10 of different diameter to form a corresponding annular shoulder 24 at the transition between the inlet region 13 and the outlet region 12. In this case, the smaller diameter or cross section of the outlet region 12 relative to that of the inlet region 13 can be equal to the diameter or cross section of the piston rod guiding portion 15, which is arranged as a further cylindrical portion of the multiplier cylinder 10 on the opposite side of the inlet region 13 from the outlet region 12. It is likewise possible for the diameter or cross section of the inlet region 13 which is radially wider than the outlet region 12 and the piston rod guiding portion 15 to be equal to the diameter or cross section of the piston guiding chamber 14, which adjoins the piston rod guiding portion 15 on the opposite side from the inlet region 13. This pairwise equality of diameters can have advantages in terms of production engineering.

FIG. 2 shows a structurally advantageous embodiment, in which the pressure intensifier cylinder 10 is manufactured as an integral component, the outlet region 12 of which directly adjoins the casting piston head chamber 6 of the casting piston/casting cylinder unit 2. This integral design for the multiplier cylinder 10, which can be mounted directly on the casting cylinder 3 of the casting unit with the multiplier piston 11 accommodated in said cylinder, has functional and production-engineering advantages. In FIG. 2, the various inlet and outlet lines 8, 19, 20, 22 and associated valves 9, 19, 21, 23 leading to corresponding pressurized fluid sources or pressurized fluid receivers, as known per se by a person skilled in the art, have been omitted. In the present case, the term "pressurized fluid" refers to any liquid or gaseous pressure medium available to a person skilled in the art for use in the particular application at hand.

As will be clear from FIGS. 1 and 2, the pressure intensifier device 1 has the multiplier piston 11 as the only moving component. There is no need for other moving components, e.g. a check valve or other moving components, to form a means of preventing a return flow. This minimizes the mechanical loads and susceptibility to wear of the multiplier 1. If the multiplier piston 11 is moved forward out of its initial position shown in FIGS. 1 and 2, to the right in FIGS. 1 and 2, the piston rod 11*b* thereof first of all moves into the inlet region 13 and then through the latter into the outlet region 12. As soon as it reaches the outlet region 12, it chokes off the fluid connection from the inlet region 13 to the outlet region 12, thereby preventing any significant return flow of pressurized fluid from the casting piston head chamber 6 to the inlet region 13. An insertion aid can be provided to ensure reliable, centered entry of the multiplier piston rod 11*b* into the outlet region 12. In the variant embodiment shown in FIG. 2, this is achieved by virtue of the fact that the inlet-side circumferential rim of the outlet region 12, which is formed by the annular shoulder 24 at the transition between the inlet region 13 and the outlet region 12, has a frustoconical insertion cone 25. To match this, the multiplier piston rod 11*b* is optionally provided at the free end thereof with a corresponding frustoconical insertion cone 26.

To provide the required pressure increase in the casting piston head chamber 6, the multiplier piston 11 moves axially forward until the free end portion of the piston rod 11*b* thereof enters the outlet region 12, wherein, depending on the embodiment and requirement, it extends into the outlet region 12 or beyond the latter into the casting piston head chamber 6 in a maximally advanced blocking position. In either case, the outlet region 12 has a sufficiently large passage cross section for the free piston rod end portion over a portion which can be passed through by the free end portion of the piston rod 11*b* during the movement of the multiplier piston 11. For this purpose, this passage cross section is at least as large as a rod cross section of the free end portion of the multiplier piston rod 11*b*. The multiplier piston rod 11*b* therefore passes unhindered through the relevant portion of the outlet region 12 without the multiplier piston 11 striking some other component during its forward motion and taking said other component along in the forward motion. This likewise minimizes susceptibility to wear and increases the functional reliability of the multiplier 1 in comparison with conventional pressure intensifier devices with an integrated or external check valve.

A controller or control unit 32 serves to control in a desired manner components of the multiplier device 1 which are to be controlled. For this purpose, it supplies, inter alia, control signals 32*a*, 32*b*, 32*c*, 32*d* for the controllable valves 9, 19, 21 and 23 mentioned. In particular, the controller 32 is designed in such a way here that it controls the multiplier inlet valve 21 and/or the multiplier outlet valve 19 independently of the pressure conditions in the casting piston/casting cylinder unit 2.

In the example shown, the pressure intensifier device furthermore optionally comprises an operative piston position sensor 33 for detecting the position of the casting piston 4 and/or a multiplier piston position sensor 34 for detecting the position of the pressure intensifier piston 11. For these position sensors 33, 34, it is possible to use any types of sensor known per se to a person skilled in the art. In this case, the control unit 32 can control the multiplier inlet valve 21 and/or the multiplier outlet valve 19 in accordance with an operative piston position signal 33*a*, which is used to inform the operative piston position sensor 33 about the respective current position of the casting piston 4, and/or in accordance with the multiplier piston position signal 34*a*, which is used to inform the multiplier piston position sensor 34 about the respective current position of the multiplier piston 11. In this case, both or just one of the position sensors is/are provided in corresponding embodiments, and both valves 19 and 21 or just one of said valves is/are controlled in this way in corresponding embodiments.

Referring now to FIGS. 3 to 8, a casting process that can be performed with the arrangement in FIGS. 1 and 2 is explained below in greater detail as an illustrative example of the casting unit operating method according to the invention, from which the characteristics and advantages of this method and of the pressure intensifier device according to the invention can be seen in greater detail. The associated control measures can be performed by the control unit 32. This can be part of an overall control system of the diecasting machine concerned or can be designed as a separate unit specifically for the casting unit.

Before a casting process, the casting piston 4 and the multiplier piston 11 are each in the initial position shown in FIGS. 1 and 2, which can be defined, for example, by respective rear mechanical stops or by an electronic control measure. The casting process then starts by the introduction of pressurized fluid or hydraulic medium into the inlet region 13 from the associated pressurized fluid source via the casting piston inlet line 22 and the opened inlet valve 23 at the beginning of a first casting phase, and, from the inlet region 13, the fluid or medium flows into the outlet region 12 of the multiplier 1, from where it enters the casting piston head chamber 6, as illustrated by a flow arrow S1. At the same time, pressurized fluid flows out of the annular casting piston chamber 7 via the associated outlet line 8 with the outlet valve 9 open, as illustrated by a flow arrow S2. As a result, the casting piston 4 moves forward, to the right in FIG. 3, as illustrated by a motion arrow B1. During this first casting phase, the casting piston 4 typically moves at a relatively low speed, as is adequate for this "pre-filling phase". During this process, the movement of the multiplier piston 11 is controlled or synchronized in such a way by appropriate control of the associated valves 19 and 21 that the fluid connection from the inlet region 13 to the outlet region 12 remains unhindered, i.e. in this first casting phase no inflow throttling of the fluid connection is operative. For this purpose, the multiplier piston 11 can remain in the maximally retracted release position thereof or can already be moving forward or already be subject to preliminary acceleration at a low speed, but only to an extent which does not lead to inflow throttling at this stage.

Figure 4:
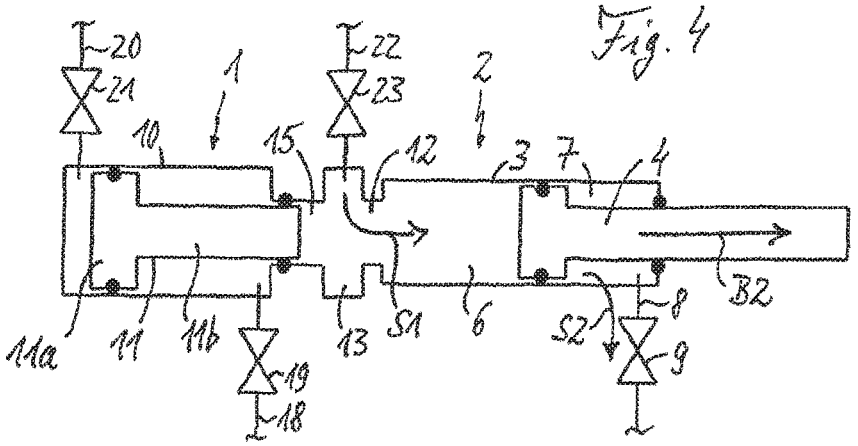
FIG. 4 shows the view of FIG. 1 in a second casting phase before the starting of the multiplier.

FIG. 4 shows the arrangement at the beginning of a subsequent second casting phase, also referred to as a die filling phase. During the transition from the first to the second casting phase, the casting piston 4 is typically accelerated to a significantly higher filling speed than its speed during the first casting phase. During this die filling phase, molten metal is forced at high speed into a casting die of the diecasting machine. The pressurized fluid flows are similar to those in the first casting phase but with partially differing pressurized fluid flow volumes or valve positions, as known per se to a person skilled in the prior art. The higher casting piston speed as compared with the first casting phase is symbolized by an extended motion arrow B2.

Figure 5:
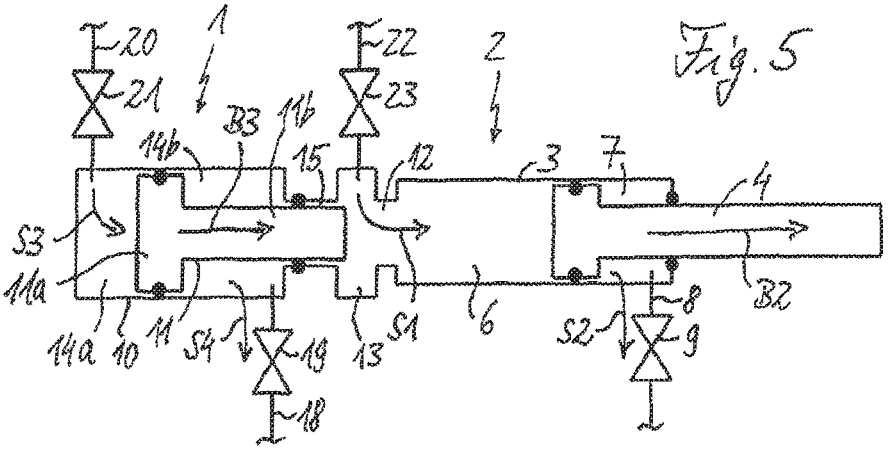
FIG. 5 shows the view of FIG. 1 during the second casting phase after the starting of the multiplier.

FIG. 5 illustrates the arrangement at a point in time at which the multiplier piston 11 has begun its forward motion. To start the forward motion of the multiplier piston 11, pressurized fluid or hydraulic medium is fed to the multiplier piston chamber 14*a* via the associated inlet line 20 with the inlet valve 21 open, as illustrated by a flow arrow S3. In terms of control engineering, the starting time of the feed motion of the multiplier is specified in a suitable manner by the control unit 32 using the relevant inlet and/or outlet valve systems of the multiplier 1, in particular by appropriate control of the associated valves 19 and 21, and, depending on requirements and the application, lies in the time interval of the die filling phase, i.e. the second casting phase, shown in FIG. 5, or, alternatively, only at the end of the die filling phase or even in the period of the pre-filling phase. At the same time, pressurized fluid is discharged from the annular multiplier chamber 14 via the associated outlet line 18 with the outlet valve 19 open, as illustrated by a flow arrow S4.

With increasing forward motion of the multiplier piston 11, the inlet region 13 and, in particular, the fluid connection between the inlet region 13 and the outlet region 12 is continuously restricted by the free end portion of the multiplier piston rod 11*b* until the free end of the multiplier piston rod 11*b* reaches the outlet region 12 and, as a result, the pressurized fluid flow S1 from the inlet region 13 to the outlet region 12 is almost completely choked off, i.e. the fluid connection between the inlet region and the outlet region 12 is blocked. The time coordination of the movement of the multiplier piston 11 and of the casting piston 4 must be precisely matched, taking into account the other requirements and circumstances of the respective casting process and, in particular, of the beginning and end of die filling with melt to ensure that the restriction or choking off of the fluid connection between the inlet region 13 and the outlet region 12 takes place neither too early nor too late. In this way, it is possible to achieve an advantageous transition from the die filling phase to a subsequent secondary compression phase, in which the casting piston 4 is severely slowed down by compression of the melt, as is known.

Figure 6:
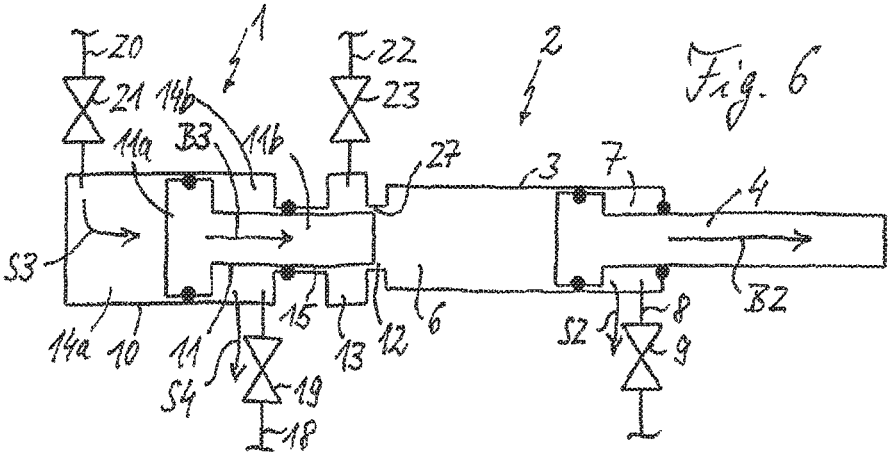
FIG. 6 shows the view of FIG. 1 at the start of the pressure increase at the beginning of a third casting phase.

FIG. 6 illustrates the arrangement at the beginning of a third casting phase, the "follow-up pressure phase" or secondary compression phase, which follows the second casting phase. For this purpose, the free end portion of the piston rod 11*b* of the multiplier piston 11 has moved forward into the outlet region 12 and thus choked off or blocked the fluid connection between the inlet region 13 and the outlet region 12. By virtue of this measure according to the invention, the compression of the pressurized fluid in the casting piston head chamber 6 can begin immediately or without delay since the forward motion of the piston rod 11*b* of the multiplier piston 11 displaces volume in the outlet region 12 and, if it moves forward to that extent, also in the casting piston head chamber 6. This improved functionality differentiates the multiplier 1 according to the invention from conventional arrangements with a check valve, which causes an inherent delay.

There can be an annular gap 27 remaining between the outer circumference of the multiplier piston rod 11*b* and an opposite rim of the outlet region 12. The annular gap 27 is kept very narrow, thus ensuring that the fluid connection between the inlet region 13 and the casting piston head chamber 6 is almost completely severed. Depending on the pressure conditions, there remains an at most extremely small leakage flow of pressurized fluid, which is not relevant to the diecasting system in terms of process and control engineering. The annular gap has a free annular cross section which is expediently significantly less than 10% and preferably less than 1%, preferably less than 0.01% to 0.1%, of the cross section of the outlet region 12 with the multiplier piston 11 retracted.

Figure 7:
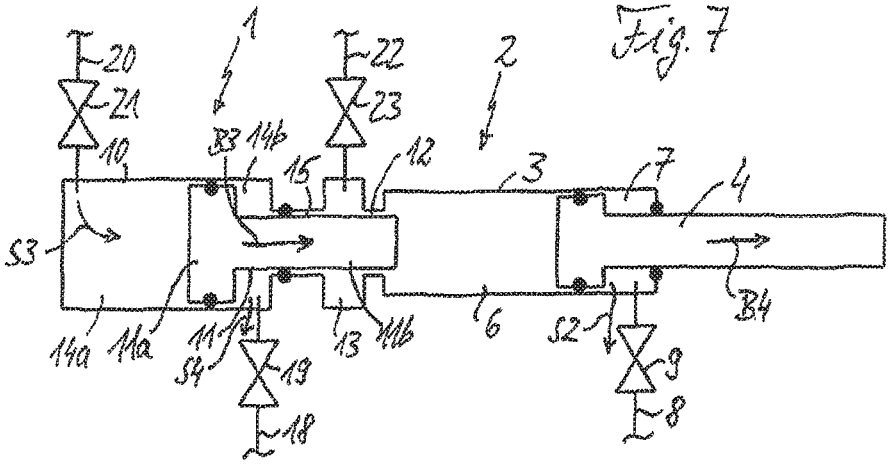
FIG. 7 shows the view of FIG. 1 during secondary compression in the third casting phase.

FIG. 7 illustrates the arrangement during subsequent progress of the third casting phase. Here, the multiplier piston 11 has moved further forward and penetrates through the outlet region 12 into the casting piston head chamber 6. As a result, the hydraulic pressure in the casting piston head chamber 6 is increased to a level desired for the process. Since the melt in the casting die is thereby also subjected to further compression, the casting piston 4 travels a small additional residual distance in an initial part of the third casting phase, this being illustrated in FIG. 7 by a motion arrow B4.

Figure 8:
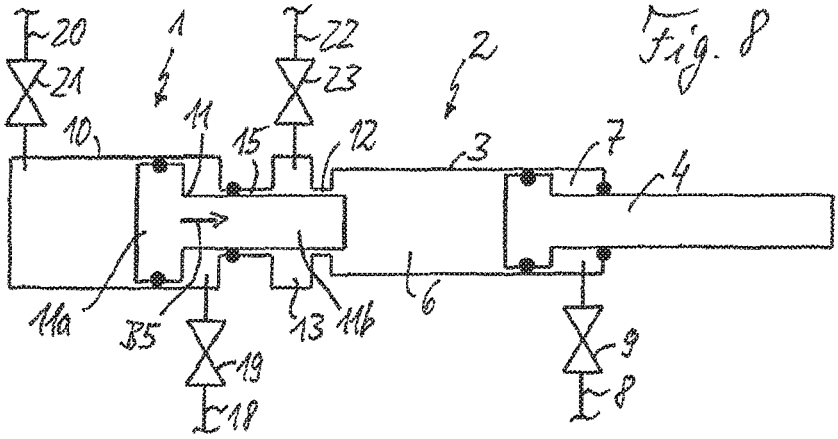
FIG. 8 shows the view of FIG. 1 at the conclusion of the third casting phase.
Figure 9:
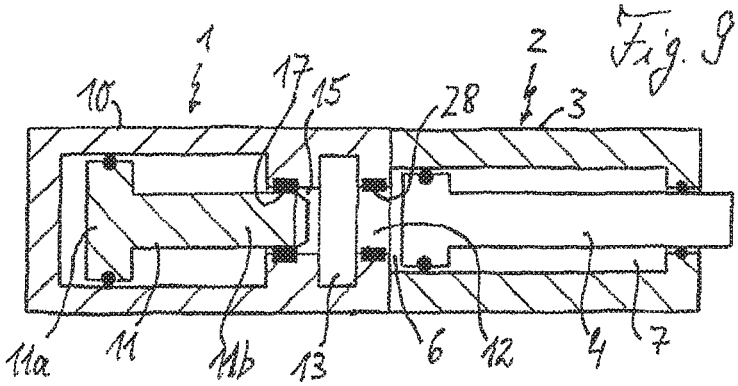
FIG. 9 shows the view of FIG. 2 relating to a variant with annular gap sealing.

FIG. 8 illustrates the arrangement at the end of the third casting phase. The casting piston 4 has come to a halt since the melt has been fully compressed with the desired casting pressure. At this point in time, the melt has already partially solidified in relevant regions of the casting runner or the die, and there is no further forward movement of the casting piston 4. The cast product cools down further in the die owing to the removal of heat.

The hydraulic pressure in the casting piston head chamber 6 is held constant by means of pressure regulation. For this purpose, the multiplier piston 11 is moved further forward only at an extremely low speed, this being illustrated by a shortened motion arrow B5 in FIG. 8, wherein it displaces only as much pressurized fluid in the casting piston head chamber 6 as flows back in the direction of the inlet region 13 through the annular gap 27 between the multiplier piston rod 11*b* and the surrounding cylindrical rim of the outlet region. By means of this measure, leakage of pressurized fluid through this annular gap 27 is compensated in a simple manner by means of the counteracting forward movement of the multiplier piston 11 in order to hold the pressure constant. For this purpose, the corresponding pressure on the multiplier system and/or on the casting cylinder system can be subjected to suitable closed-loop control in a manner known per se by means of the controller 32 through control of the associated valves.

As will be clear from the above explanation of a casting process that can be carried out by means of the multiplier according to the invention, the multiplier according to the invention makes possible a reduction in the pressure rise time for the secondary pressure phase as compared with conventional multiplier devices with a check valve. Toward the end of the die filling phase, the multiplier chokes off the inflow of pressurized fluid to the casting piston head chamber, after which the pressure buildup in the casting piston head chamber immediately takes place virtually without delay. The multiplier according to the invention can be of robust and compact construction and can be embodied with the multiplier piston as the only moving component.

Particularly when the operating method according to the invention is used, the multiplier piston can already be set in motion sufficient early to ensure that it already has a relatively high speed at the end of the die filling phase or at the beginning of the secondary pressure phase and hence can achieve a correspondingly rapid pressure rise. Whereas there is an unavoidable dead time due to the duration of closing in the case of conventional multiplier systems with a spring-loaded check valve, this being the result of the valve mass accelerated by means of spring force, this dead time is eliminated in the present case owing to the elimination of such a check valve. In the present case, the pressure rise time now consists only of the time duration component that remains by virtue of the principle involved, due to the finite volume displacement rate for the compression of the pressurized fluid in the casting piston head chamber.

In corresponding embodiments, the pressure intensifier inlet valve is controlled in accordance with the operative piston position signal of the operative piston position sensor and/or in accordance with the multiplier piston position signal of the multiplier piston position sensor, and/or the pressure intensifier backpressure valve is controlled in accordance with the operative piston position signal of the operative piston position sensor and/or with the multiplier piston position signal of the multiplier piston position sensor. In the present case, unless stated otherwise, the term "control" is intended to include both the possibility of pure open-loop control and the possibility of closed-loop control. As a result, the feed motion of the pressure intensifier piston is independent of the pressure conditions in the various pressure chambers involved. If required, provision can be made to exercise open-loop or closed-loop control of the feed motion of the pressure intensifier piston as regards the progress thereof with respect to time along the complete stroke thereof from the maximally retracted to the maximally advanced position or only along a subsection of said complete stroke in accordance with a predetermined setpoint profile of the progress with respect to time of the path of movement or speed of movement of the multiplier piston.

As an alternative, provision can be made for the control unit to perform open-loop or closed-loop control of the feed motion of the pressure intensifier piston as regards the progress thereof with respect to time along the complete stroke thereof from the maximally retracted to the maximally advanced position or only along a subsection of said complete stroke in accordance with a predetermined setpoint profile of the progress with respect to time of the pressure in the pressurized fluid chamber of the piston/cylinder unit, i.e. in the casting piston head chamber, through appropriate control of the pressure intensifier inlet valve and/or of the pressure intensifier backpressure valve. For this purpose, the control unit uses pressure sensor signals from a pressure sensor system, which is conventional and is therefore not shown specifically here, which is associated in a customary manner with the casting piston/casting cylinder unit of the diecasting machine.

Such setpoint-profile-assisted control of the feed motion of the multiplier piston can be based, for example, on a pre-calculation, which, in particular, includes pre-calculation of the desired point in time at which the multiplier chokes off the flow of pressurized fluid into the casting piston head chamber. The subsequent, multiplier-driven pressure rise is determined by the area-weighted differential speed of the multiplier piston and the working piston of the piston/cylinder unit, that is to say, in the case of the diecasting application, of the casting piston or casting cylinder piston. If desired, the speed of the multiplier piston can be matched to the speed of the casting/working piston in such a way that the pressure rise assumes a certain value or follows a desired time progression. If required, the pressure rise can also be reduced temporarily to zero here, i.e. there is a constant pressure, or can temporarily be set to a negative value, which then corresponds to a pressure reduction.

The multiplier according to the invention requires only a few components and is relatively easy to assemble. The risk of a spring break of the kind which exists with spring-loaded check valves, is completely eliminated. Whereas, in the case of conventional systems with a spring-loaded check valve, said valve can begin to vibrate or even knock, depending on design and throughflow, this characteristic, which is detrimental to the casting process and the service life of the casting unit, is eliminated in the present case thanks to the elimination of the check valve and to the corresponding absence of a spring-mass system.

Another advantage of the invention in the absence of a check valve is that flow pressure losses from the pressurized fluid source, via the inlet valve and as far as the casting piston, especially during the second casting phase, are reduced. This allows a smaller design of casting system and/or casting with a higher casting force.

The advantages and characteristics of the invention apply equally to systems in which the speed of the casting piston is subject to closed-loop control and to systems with pure open-loop control of the speed of the casting piston. In other words, the multiplier according to the invention can be used in a casting unit irrespective of the type of casting cylinder control. The possibility of use is also independent of whether and in what way "differential control systems", which feed back the outflowing pressurized fluid flow to assist the inflowing pressurized fluid, are present on the casting unit. Here, the movement of the multiplier makes available an additional pressurized fluid flow for the casting cylinder by volume displacement. In general, the compressibility of the melt is extremely low, with the result that the pressure rise acts substantially via the volume displacement of the advancing multiplier piston.

FIGS. 9 to 12 illustrate, by way of example, some further embodiments of the pressure intensifier device according to the invention as variants of the design shown in FIG. 2. The illustrative embodiment in FIG. 9 differs from that in FIG. 2 in that an additional sealing and/or guiding system 28 is provided, preferably as a separate component mounted on the inner rim of the outlet region 12, in order to seal the annular gap region between the inner rim of the outlet region 12 and the advancing multiplier piston rod 11*b*. In this embodiment, the additional sealing and/or guiding system 28 ensures corresponding additional sealing of the annular gap 27 or additional guidance of the multiplier piston rod 11*b* in the outlet region 12. The sealing and/or guiding system 28 can also have a gap-modifying function, e.g. by being designed in such a way that it influences the sealing effect, e.g. reduces the gap in order to reduce the leakage backflow, as a function of the pressure, e.g. as a function of the pressure in the casting piston head chamber 6. The sealing/guiding system 17 in the region of the piston rod guiding portion 15 of the multiplier cylinder 10 can likewise be implemented and arranged in this way.

In the embodiment shown in FIG. 10, the inlet region contains an axial portion 13*a* and a radial inlet bore 13*b* opening from the outside into said portion, which extends through a housing wall of the pressure intensifier cylinder 10. The axial inlet portion 13*a* is formed by a common axial central bore in the pressure intensifier cylinder 10, having an identical diameter to the outlet region 12 and the piston rod guiding portion 15. In this embodiment of the piston rod guiding portion 13, therefore, the axial inlet portion 13*a* and the outlet region 12 merge into one another without a sharp division. As an alternative to the single radial inlet bore 13*b* shown, a plurality of radial inlet bores can be arranged in a manner distributed over the circumference of the multiplier cylinder 10. As an option, additional sealing and/or guiding systems can be arranged, in a manner not shown, axially in front of and/or behind the point or points of entry of the one or more inlet bores 13*b*. In this embodiment, the blocking of the fluid connection between the inlet region 13*a*, 13*b* and the outlet region 12 is accomplished by virtue of the fact that the piston rod 11*b* of the advancing multiplier piston 11 shuts off the entry of the radial inlet bore 13*b* into the axial inlet portion 13*a*.

In the embodiment shown in FIG. 11, the multiplier piston rod 11*b* has, at the free end portion thereof, an axial central bore 29 opening at the end and one or more radial inlet bores 30, which extend from the outer circumference of the multiplier piston rod 11*b* to the central bore 29 at a predetermined distance from the end of said piston rod. In this embodiment, the free piston rod end portion of the piston rod 11*b* of the multiplier piston 11 can extend into the outlet region 12 even in the maximally retracted release position. The pressurized fluid passes from the inlet region 13, via the one or more radial bores 30, to the central bore 29 of the multiplier piston rod 11*b* and, from there, into the casting piston head chamber 6, as illustrated by a flow arrow S5. To block the fluid connection between the inlet region 13 and the outlet region 12, the multiplier piston 11 is moved forward until the radial inlet bores 30 have moved completely out of the inlet region 13 into the outlet region 12. The inner rim of the outlet region 12 then shuts off the entry of the one or more radial inlet bores 30 and thus blocks the pressurized fluid path between the inlet region 13 and the outlet region 12.

In this implementation, the mechanical insertion aid region for the entry of the multiplier piston rod 11*b* into the outlet region 12 can be omitted. The multiplier piston rod 11*b* is in the outlet region 12 along the entire path of movement of the multiplier piston 11 between the maximally retracted release position thereof and the maximally advanced blocking position thereof and can be guided by said outlet region.

In the embodiment shown in FIG. 12, the multiplier piston rod 11*b* has, at the free end portion thereof, one or more longitudinal groove channels 31, which are introduced on the outside of the free end portion of the multiplier piston rod 11*b*, from the end thereof as far as a predetermined channel length. In the illustrative embodiment in FIG. 12 too, as in the illustrative embodiment in FIG. 11, the piston rod 11*b* of the multiplier piston 11 can also always extend into the outlet region 12, even in the maximally retracted release position of the multiplier piston 11 shown in FIG. 12. In the release position, the pressurized fluid can flow from the inlet region 13, via the longitudinal groove channel or channels 31, through the outlet region 12 and into the casting piston head chamber 6, as illustrated by a flow arrow S6. In this case too, an insertion aid for the entry of the advancing multiplier piston rod 11*b* into the outlet region 12 can be omitted. In this example, the blocking of the fluid connection between the inlet region 13 and the outlet region 12 can be brought about by virtue of the fact that the multiplier piston rod 11*b* is moved forward until the longitudinal groove channels 31 have moved completely out of the inlet region 13 into the outlet region 12. The multiplier piston rod 11*b* then once again shuts off the pressurized fluid path between the inlet region 13 and the outlet region 12, optionally while leaving the slight annular gap mentioned above.

In other respects, the characteristics and advantages indicated for the embodiment shown in FIGS. 1 to 8 apply in corresponding fashion to the illustrative embodiments in FIGS. 9 to 12, and reference can be made to these.

In the embodiments in FIGS. 1 to 12, the multiplier 1 is arranged as an extension of the piston/cylinder unit 2 controlled thereby, i.e. with the longitudinal axes of both piston/cylinder units 1, 2 aligned. As an alternative, any other geometrical arrangement of the multiplier 1 relative to the piston/cylinder unit 2 controlled thereby is possible, in particular angle arrangements, in which the longitudinal axis of the multiplier piston 11 encloses any desired predetermined angle to the longitudinal axis of the casting piston 4. In this respect, FIG. 13 shows an illustrative embodiment in which a multiplier 1' is arranged at an angle of 90° relative to a piston/cylinder unit 2' controlled thereby, wherein in other respects the multiplier 1' can correspond to that in FIGS. 1 to 12, and the controlled piston/cylinder unit 2' can likewise correspond to that in FIGS. 1 to 12. In other alternative embodiments, the multiplier is arranged with the longitudinal axis of the multiplier piston arranged offset in parallel with respect to the longitudinal axis of the casting piston or is in an opposed arrangement. In the latter case, the longitudinal axis of the multiplier piston is parallel to the longitudinal axis of the casting piston but the multiplier piston moves in the opposite direction to the motion of the casting piston.

The invention claimed is:

1. A pressure intensifier device for increasing pressure in a pressurized fluid chamber of a piston/cylinder unit, comprising:

a pressure intensifier cylinder; and a pressure intensifier piston, which is guided in an axially movable manner in the cylinder, wherein the pressure intensifier cylinder comprises an outlet region embodied without a check valve, an inlet region upstream of the outlet region, and a piston guiding chamber having at least one of a pressure intensifier piston chamber, into which a pressure intensifier inlet line opens, and a pressure intensifier backpressure chamber, into which a pressure intensifier backpressure line opens, the pressure intensifier piston comprises a piston part, which is guided in the piston guiding chamber, and a piston rod, which extends from the piston part to the inlet region, in a retracted release position releases a fluid connection between the inlet region and the outlet region and, in an advanced blocking position, blocks this connection with a free end portion, with which it extends into the outlet region, over a portion that can be passed through by the free end portion of the piston rod during movement from the release position into the blocking position, the outlet region comprises a free passage cross section for the free piston rod end portion that is at least equal in size to a rod cross section of the free piston rod end portion, and the outlet region is designed as a portion of the pressure intensifier cylinder which is narrowed radially relative to the inlet region, wherein there is provided at least one of a diameter of the outlet region being greater than a diameter of the free piston rod end portion in order to form an intermediate open or sealed annular gap between the free piston rod end portion, in the blocking position thereof, and a circumferential rim of the outlet region, and a circumferential rim of the outlet region having an insertion cone on the inlet side.

2. The pressure intensifier device as claimed in claim 1, wherein there is provided at least one of a pressure intensifier inlet valve, which is controlled independently of a pressure in the pressurized fluid chamber of the piston/cylinder unit and arranged in the pressure intensifier inlet line, and a pressure intensifier backpressure valve, which is controlled independently of a pressure in the pressurized fluid chamber of the piston/cylinder unit and arranged in the pressure intensifier backpressure line.

3. The pressure intensifier device as claimed in claim 2, wherein the pressure intensifier cylinder is manufactured as a one-piece component.

4. The pressure intensifier device as claimed in claim 2, wherein the pressure intensifier cylinder comprises a piston rod guiding portion between the piston guiding chamber and the inlet region.

5. The pressure intensifier device as claimed in 2, wherein the outlet region and the inlet region have portions with a same cross section of the pressure intensifier cylinder, and the inlet region contains a radial inlet bore, which opens radially from the outside into said portion of the pressure intensifier cylinder.

6. The pressure intensifier device as claimed in claim 2, wherein the inlet region comprises at least one radial bore and an axial bore in the free piston rod end portion, where said axial bore is connected to said at least one radial bore and opens at an end face.

7. The pressure intensifier device as claimed in a claim 2, wherein the inlet region comprises at least one axial longitudinal groove channel on an outer circumferential side of the free piston rod end portion.

8. The pressure intensifier device as claimed claim 2, further comprising a ring seal on an inner rim of the outlet region.

9. The pressure intensifier device as claimed in claim 2, further comprising:

at least one of: (i) an operative piston position sensor for detecting the position of a piston of the piston/cylinder unit, and (ii) a multiplier piston position sensor for detecting the position of the pressure intensifier piston, and a controller, which controls at least one of: (i) the pressure intensifier inlet valve in accordance with an operative piston position signal of the operative piston position sensor and/or a multiplier piston position signal of the multiplier piston position sensor, and (ii) the pressure intensifier backpressure valve in accordance with an operative piston position signal of the operative piston position sensor and/or a multiplier piston position signal of the multiplier piston position sensor.

10. The pressure intensifier device as claimed in claim 1, wherein the pressure intensifier cylinder is manufactured as a one-piece component.

11. The pressure intensifier device as claimed in claim 1, wherein the pressure intensifier cylinder comprises a piston rod guiding portion between the piston guiding chamber and the inlet region.

12. The pressure intensifier device as claimed in claim 1, wherein the outlet region and the inlet region have portions with a same cross section of the pressure intensifier cylinder, and the inlet region contains a radial inlet bore, which opens radially from the outside into said portion of the pressure intensifier cylinder.

13. The pressure intensifier device as claimed in claim 1, wherein the inlet region comprises at least one radial bore and an axial bore in the free piston rod end portion, where said axial bore is connected to said at least one radial bore and opens at an end face.

14. The pressure intensifier device as claimed in claim 1, wherein the inlet region comprises at least one axial longitudinal groove channel on an outer circumferential side of the free piston rod end portion.

15. The pressure intensifier device as claimed claim 1, further comprising a ring seal on an inner rim of the outlet region.

16. A casting unit for a diecasting machine, comprising:

a casting piston/casting cylinder unit; and a pressure intensifier device designed to increase pressure in a pressurized fluid chamber of the casting piston/casting cylinder unit and comprising a pressure intensifier cylinder and a pressure intensifier piston, which is guided in an axially movable manner in the cylinder, wherein the pressure intensifier cylinder comprises an outlet region embodied without a check valve, an inlet region upstream of the outlet region, and a piston guiding chamber having at least one of a pressure intensifier piston chamber, into which a pressure intensifier inlet line opens, and a pressure intensifier backpressure chamber, into which a pressure intensifier backpressure line opens, the pressure intensifier piston comprises a piston part, which is guided in the piston guiding chamber, and a piston rod, which extends from the piston part to the inlet region, in a retracted release position releases a fluid connection between the inlet region and the outlet region and, in an advanced blocking position, blocks this connection with a free end portion, with which it extends into the outlet region, over a portion that can be passed through by the free end portion of the piston rod during movement from the release position into the blocking position, the outlet region comprises a free passage cross section for the free piston rod end portion that is at least equal in size to a rod cross section of the free piston rod end portion, and the outlet region is designed as a portion of the pressure intensifier cylinder which is narrowed radially relative to the inlet region, wherein there is provided at least one of a diameter of the outlet region being greater than a diameter of the free piston rod end portion in order to form an intermediate open or sealed annular gap between the free piston rod end portion, in the blocking position thereof, and a circumferential rim of the outlet region, and a circumferential rim of the outlet region having an insertion cone on the inlet side.

17. A method for operating a diecasting machine casting unit according to claim 16, the method comprising the steps of:

carrying out a respective casting process with a casting piston moved forward successively as a pre-filling phase, a die filling phase and a follow-up pressure phase; and starting a feed motion of the pressure intensifier piston of the pressure intensifier device before the end of the die filling phase.

18. The method as claimed in claim 17, wherein the feed motion of the pressure intensifier piston is started at the beginning of or during the pre-filling phase.

19. The method as claimed in claim 17, wherein the feed motion of the pressure intensifier piston is controlled in accordance with at least one of an operative piston position signal of an operative piston position sensor and a multiplier piston position signal of a multiplier piston position sensor.

20. The method as claimed in claim 17, wherein the feed motion of the pressure intensifier piston is subject to open-loop or closed-loop control as regards to its progress with respect to time along its complete stroke or only along a subsection thereof in accordance with a predetermined setpoint profile of the progress with respect to time of movement path or movement speed of the multiplier piston or in accordance with a predetermined setpoint profile of the progress with respect to time of the pressure in the pressurized fluid chamber of the casting piston/casting cylinder unit.

* * * * *